United States Patent [19]

Hyde

[11] Patent Number: 4,940,081

[45] Date of Patent: Jul. 10, 1990

[54] CHECKER BRICK

[75] Inventor: Jack Hyde, Pittsburgh, Pa.

[73] Assignee: North American Refractories Company, Cleveland, Ohio

[21] Appl. No.: 386,947

[22] Filed: Jul. 31, 1989

[51] Int. Cl.[5] ..... F28D 17/02

[52] U.S. Cl. ..... 165/9.1; 165/9.2

[58] Field of Search ..... 165/9.1, 9.2, 9.3

[56] References Cited

U.S. PATENT DOCUMENTS

| | | | |
|---|---|---|---|
| 490,726 | 1/1893 | Stevenson | 165/9.3 |
| 1,963,291 | 6/1934 | Brown, Jr. et al. . | |
| 2,017,763 | 10/1935 | Mamula et al. . | |
| 3,777,805 | 12/1973 | Racasens et al. | 165/9.1 |
| 4,436,144 | 3/1984 | Horak | 165/9.1 |
| 4,540,039 | 9/1985 | Karl | 165/9.1 |
| 4,651,810 | 3/1987 | Triessnig | 165/9.1 |

FOREIGN PATENT DOCUMENTS

| | | | |
|---|---|---|---|
| 3317876 | 12/1984 | Fed. Rep. of Germany | 165/9.1 |
| 580226 | 11/1977 | U.S.S.R. | 165/9.1 |

*Primary Examiner*—Albert W. Davis, Jr.

*Attorney, Agent, or Firm*—Jones, Day, Reavis & Pogue

[57] ABSTRACT

A checker brick has a plurality of walls intersecting at a plurality of spaced intersections. Four walls extend outwardly from each intersection in equidistantly-spaced relationship to one another. One of the four walls at each intersection is a common wall that extends between adjacent intersections. The other three walls at each intersection are independent walls. Mating projections and recesses are provided on the opposite surfaces of the brick at the intersections for interlocking bricks stacked in tiers.

25 Claims, 5 Drawing Sheets

CHECKER BRICK

BACKGROUND OF THE INVENTION

This application relates to the art of refractory bricks and, more particularly, to checker bricks used for recovering heat in recuperators.

It would be desirable to have a checker brick with an optimum heating surface area, and that is relatively simple to manufacture and install.

SUMMARY OF THE INVENTION

A checker brick has a plurality of walls intersecting at a plurality of spaced-apart intersections. Four walls extend outwardly from each intersection in equidistantly-spaced relationship to one another. One of the four walls at each intersection is a common wall that extends between adjacent intersections. The other three walls at each intersection are independent walls, and include a pair of independent transverse walls extending substantially perpendicular to the common wall, and an independent end wall extending substantially perpendicular to the transverse walls in alignment with the common wall.

The intersections have intersection centerlines and the independent walls have outer end surfaces. In a preferred arrangement, all of the independent walls have substantially the same length measured from an intersection centerline to the outer end surface of each independent wall. This provides square flues through a checkerwork of stacked bricks. It is possible to use two different bricks having different wall lengths to provide rectangular flues.

The brick includes substantially parallel plane top and bottom surfaces, and the end surfaces are cut-away adjacent at least one of the top and bottom surfaces to provide transverse gas flow passages between adjacent stacked bricks.

The length of a common wall, as measured between adjacent intersection centerlines, is not less than two times the length of an independent wall as measured from an intersection centerline to the outer end surface of the independent wall. Preferably, such length of the common wall is slightly greater than such length of an independent wall.

Mating projections and recesses are provided on the top and bottom surfaces of the brick coincidental with the intersection centerlines. The projections and recesses are interdigitated in adjacent tiers of stacked bricks.

All of the brick walls preferably have a common thickness. The bricks are preferably stacked in such a manner that one brick in one tier engages two bricks in an adjacent tier. However, it is possible to use bricks having different wall thicknesses.

The sides of the walls can slope outwardly from the top surface toward the bottom surface. Thus, the walls are substantially wider at the bottom surface than at the top surface. When such bricks are stacked, the wider bottoms of the walls on an upper tier of bricks project outwardly beyond the narrower tops of the walls on a lower tier of bricks. This provides horizontal ledges in the checkerwork flues for enhancing turbulent flow and more efficient heat transfer.

Horizontal ledges for enhancing turbulence can also be formed by making at least two different bricks with two different wall thicknesses. Stacking bricks with thicker walls on top of bricks with thinner walls creates the horizontal ledges.

The brick of the present application is cooperable with the regenerator walls at the outer perimeter of a checkerwork to provide flues.

It is a principal object of the present invention to provide an improved checker brick having an optimum heating surface area.

It is another object of the invention to provide a checker brick wherein all of the walls have a common thickness that enables makeup of a one thickness dye.

It is a further object of the invention to provide an improved checker brick that is easy to install.

It is also an object of the invention to provide an improved checker brick that has good vertical alignment of vertical flues, and has good cross-flow to provide turbulence for optimum heat transfer.

It is an additional object of the invention to provide an improved checker brick that is stacked in such a way that blockage of vertical flues by solid particles is minimized.

DESCRIPTION OF PREFERRED EMBODIMENTS

Figure 1:
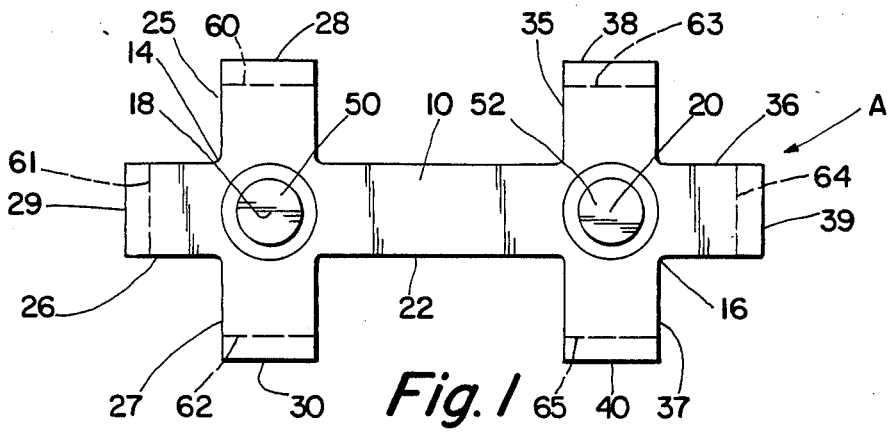
FIG. 1 is a top plan view of a checker brick constructed in accordance with the present application.
Figure 2:
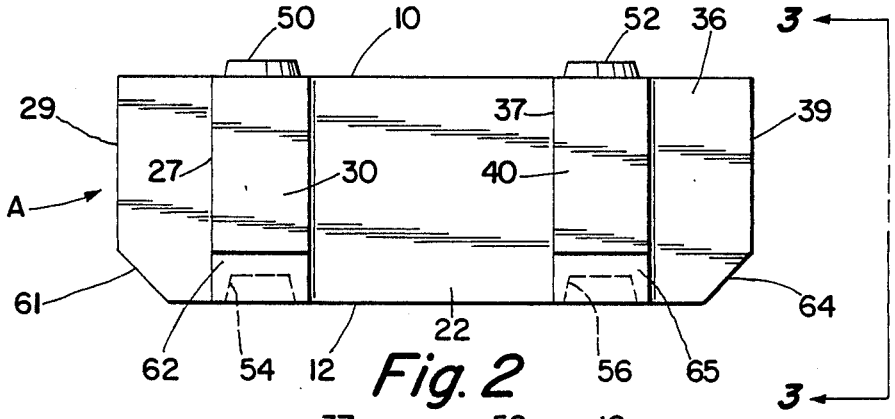
FIG. 2 is a side elevational view of the checker brick of FIG. 1.
Figure 3:
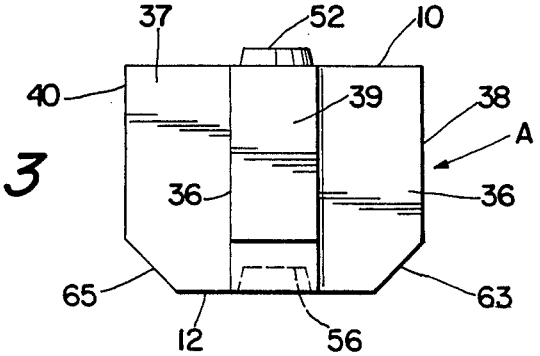
FIG. 3 is an end elevational view taken generally on line 3—3 of FIG. 2.

Referring now to the drawing, wherein the showings are for purposes of illustrating certain preferred embodiments of the invention only and not for purposes of limiting same, FIGS. 1–3 show a checker brick A having substantially plane and parallel top and bottom surfaces 10, 12.

Brick A has a plurality of intersecting walls having top and bottom wall surfaces that are coincidental with brick top and bottom surfaces 10, 12. The plurality of intersecting walls intersect at a plurality of spaced-apart intersections, only two of which are shown at 14, 16 in FIG. 1. It will be recognized that the brick could be constructed with three or more such intersections spaced the same distance apart along a common centerline. Each intersection 14, 16 has an intersection centerline extending perpendicular to the plane of the paper in FIG. 1 and represented by dots 18, 20 in FIG. 1.

At each intersection 14, 16, four walls extend outwardly from each intersection centerline 18, 20 in equidistantly-spaced relationship to one another.

One of the four walls that extends outwardly at each intersection is defined by a common wall 22 extending between adjacent intersections 14, 16. The other three walls extending outwardly at each intersection are independent walls. Thus, there are independent walls 25, 26 and 27 extending outwardly at intersection 14, and independent walls 35, 36 and 37 extending outwardly at intersection 16.

Each independent wall 25–27 has an outer end surface 28–30 extending substantially perpendicular to brick top and bottom walls 10, 12. Each independent wall 35–37 has an outer end surface 38–40 extending substantially perpendicular to brick top and bottom surfaces 10, 12.

As shown in FIG. 1, all of the walls, including the common wall and the independent walls, have substantially the same thickness. This simplifies dye makeup for molding the brick.

The length of each independent wall is substantially the same as measured from an intersection centerline to an outer end surface thereof. Thus, the length of an independent wall 25 as measured from intersection centerline 18 to outer end surface 28 is the same as the length of all the other independent walls measured the same way.

The independent walls that project outwardly at each intersection include a pair of transverse independent walls 28, 30 or 38, 40 that extend substantially perpendicular to common wall 22. The independent walls at each intersection also include an independent end wall 29 or 39 that extend substantially perpendicular to the transverse walls and are aligned with common wall 22.

The length of common wall 22, as measured between adjacent intersection centerlines 18, 20 is not less than two times the length of an independent wall measured from an intersection centerline to the outer end surface of such independent wall. Preferably, such length of common wall 22 is slightly greater than two times the length of an independent wall. This automatically spaces adjacent facing end surfaces on adjacent bricks from one another when stacking the bricks in a checkerwork so that transverse flow passages are provided.

Projections 50, 52 extend upwardly from brick top surface 10 at each intersection 14, 16 coincidental with intersection centerlines 18, 20. Mating recesses 54, 56 extend inwardly of brick bottom surface 12 at each intersection 14, 16 coincidental with intersection centerlines 18, 20. The projections and recesses on stacked bricks are interdigitated with one another to interlock the adjacent stacked bricks. In a preferred arrangement, the projections and recesses are generally frusto-conical in shape. However, it will be recognized that other shapes of interlocking projections and recesses can be used.

Figure 6:
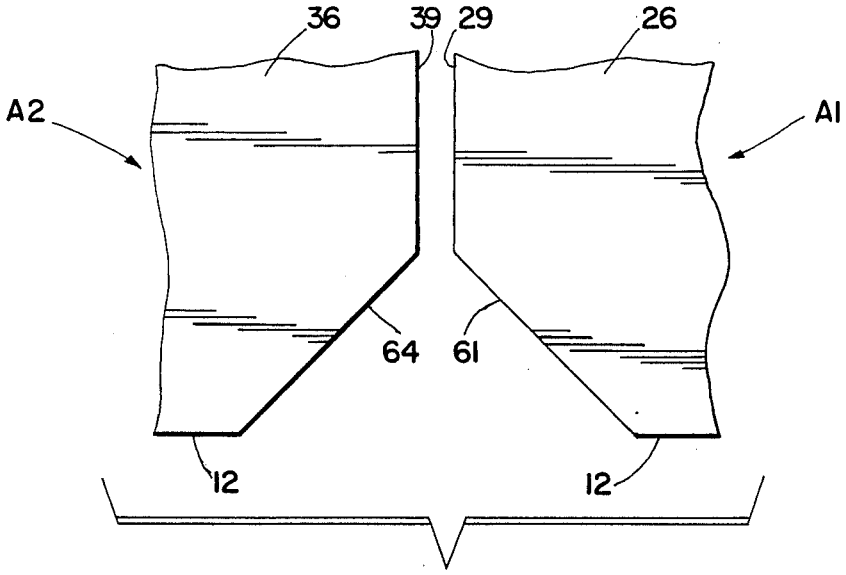
FIG. 6 is a partial enlarged side elevational view showing cut-away end surfaces on brick walls to provide enhanced transverse flow passages.

Each independent wall has its outer end surface cut-away or notched as indicated at 60–65. The notches or cut-away portions are better shown with reference to FIG. 6 wherein a pair of adjacent bricks A1, A2 have outer end surfaces 29, 39 on independent walls 26, 36 positioned in slightly spaced opposed facing relationship. Each notch 60–65 is inclined at an angle of about 45° to bottom surface 12 and to the outer end surfaces of the independent walls. The height of each notch, as measured from bottom surface 12 to the intersection of the inclined notch surface with a wall outer end surface, is substantially less than one-half the height of the brick. In one arrangement, the notches have been made approximately one-fifth the height of the brick. Obviously, the notches can be provided adjacent the brick top surface but are preferably located adjacent the bottom surface as shown in the drawing. The notches effectively increase the bottom surface area of the brick so that a greater surface area is contacted by hot gases passing through the checkerwork. The height of the notches is also somewhat greater than the height of projections 50, 52 or the depth of recesses 54, 56.

The distance that each transverse independent wall 25, 27, 35 and 37 projects freely outward from common wall 22 and end walls 26, 36 is preferably between one and one and one-half times the thickness of the walls. Likewise, the distance that independent end walls 26, 36 project freely outwardly from the transverse independent walls is between one and one and one-half times the thickness of each wall.

Figure 4:
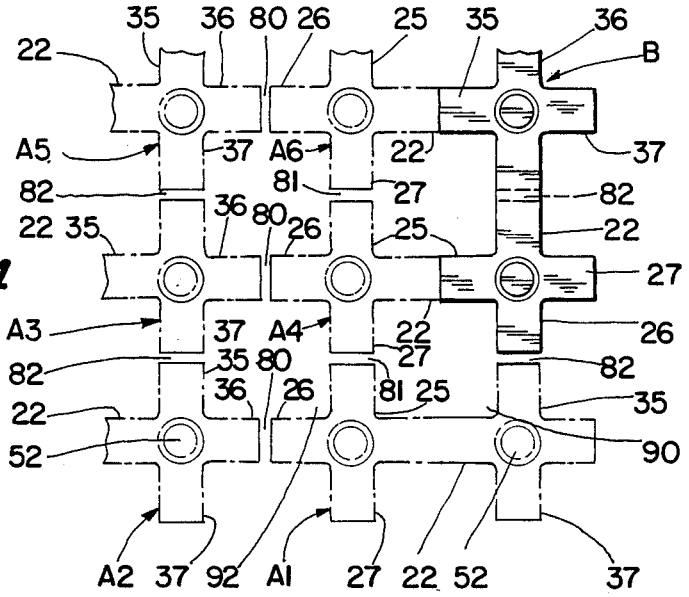
FIG. 4 is a plan view of stacked bricks, with the bricks in one tier being in phantom and a brick in a next higher tier being in solid lines.

FIG. 4 shows a plurality of bricks A1–A6 positioned horizontally adjacent one another in a tier. Bricks A1–A6 are positioned with at least a portion of their bottom surfaces 12 of FIGS. 2 and 3 resting on supports. Bricks A1–A6 are positioned such that the opposed facing outer end surfaces of the independent walls are spaced-apart from one another. Thus, the outer facing end surfaces of end walls 26, 36 on adjacent bricks have spaces 80 therebetween. The outer facing surfaces of independent transverse walls 25, 27 have spaces 81 therebetween. The facing outer surfaces of transverse independent walls 35, 37 have spaces 82 therebetween. Preferably, all of spaces 80, 81 and 82 are approximately the same.

A next higher tier of bricks is stacked on top of bricks A1–A6, and only one brick B is indicated in FIG. 4 for the next higher tier. Bricks A1–A6 are positioned with their common walls 22 extending parallel to one another and with their transverse independent walls aligned. The next higher tier of bricks B is also positioned with their common walls 22 extending parallel to one another but extending perpendicular to the common walls of bricks A1–A6. In addition, bricks B are positioned such that they rest on at least two of the bricks in the adjacent tiers. Brick B is shown supported on bricks A4, A6, and the recesses 54, 56 in the bottom surface of brick B receive projections 52 on bricks A4, A6. Obviously, other arrangements can be provided for interlocking the bricks in adjacent tiers. However, it is desirable that a majority of the bricks in each tier engage two bricks in an adjacent tier in order to provide effective interlocking by the interdigitated projections and recesses.

With reference to FIG. 4, it will be recognized that adjacent bricks A1, A4 have their common walls 22 and their independent transverse walls 25, 27 and 35, 37 defining a vertical flue 90. Adjacent bricks A1, A2, A3 and A4 have another vertical flue 92 defined by independent end walls 26, 36 and independent transverse walls 25, 27 and 35, 37. The next higher tier of bricks B continues the vertical flues. Spaces 80, 81 and 82 are provided between facing outer end surfaces of the independent walls in each tier of bricks. Some of such spaces may be continuous throughout the vertical extent of the flue, and other such spaces will alternate from one tier to the next because of the alternate positioning of the common walls. The spaces 80, 82 and the notches 60–65 provide transverse passages between adjacent vertical flues to provide turbulent flow and increase heat transfer to the bricks.

Figure 5:
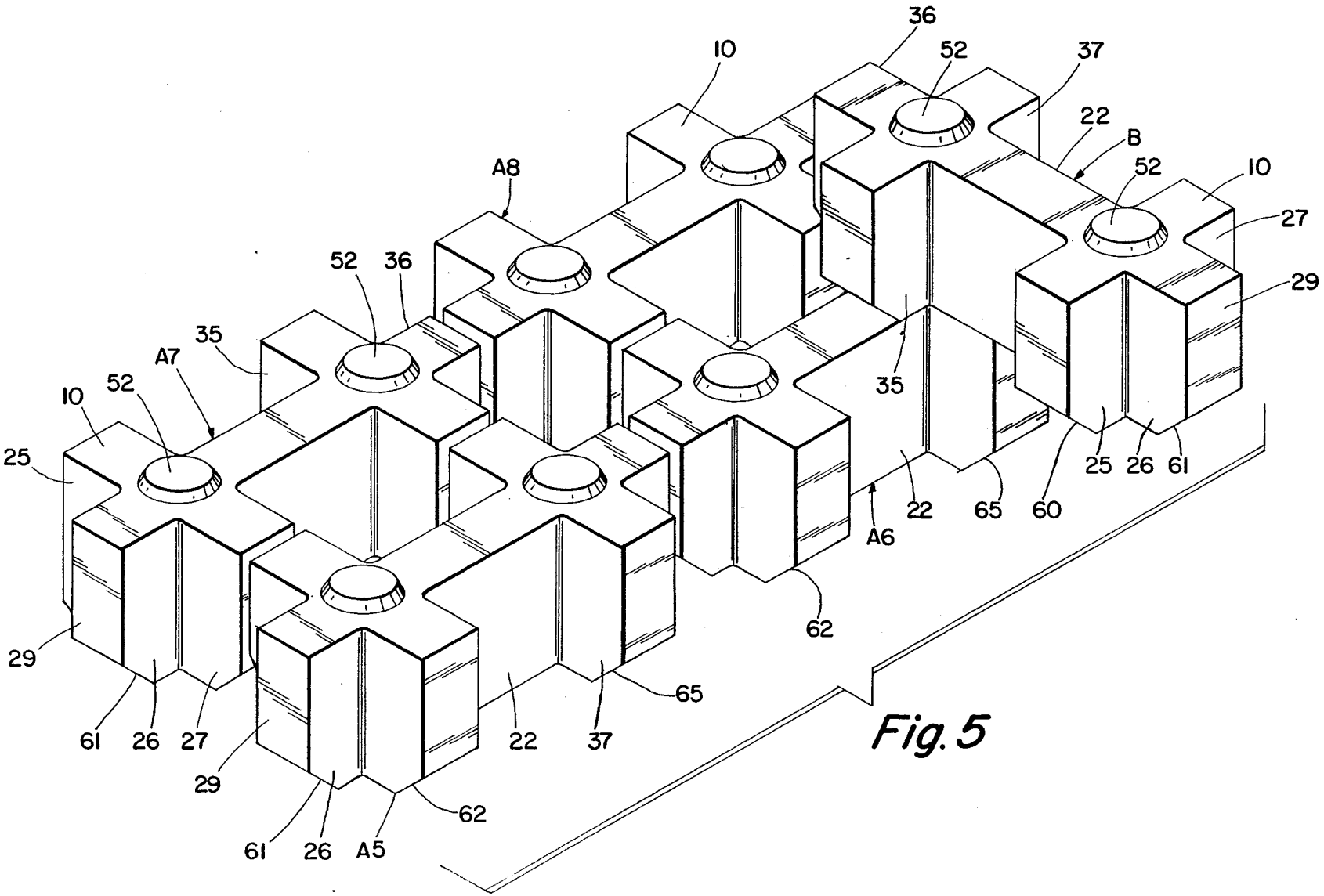
FIG. 5 is a perspective illustration of checker bricks stacked on one another.

FIG. 5 is a perspective illustration showing how the bricks are arranged in stacked tiers. Bricks A7, A8 are additional bricks in the bottom tier.

Figure 7:
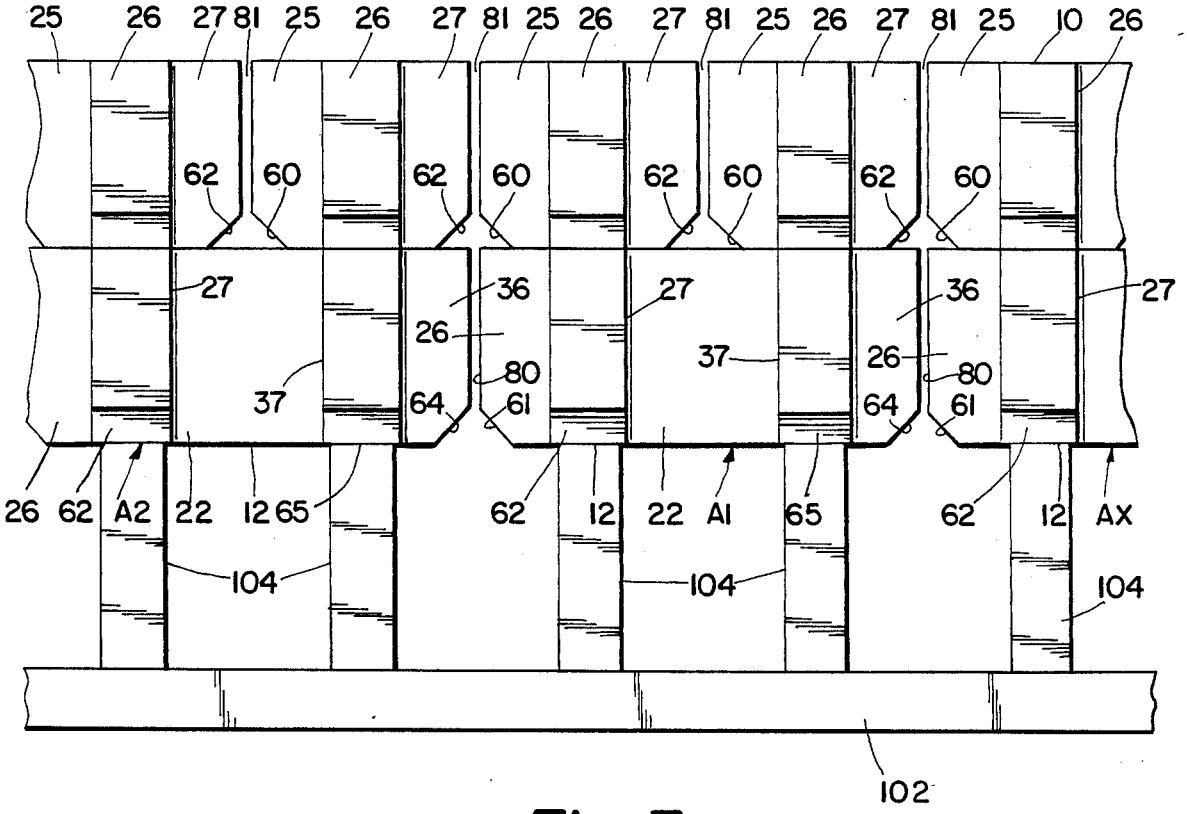
FIG. 7 is a side elevational view of bricks that are stacked to form a checkerwork.

FIG. 7 shows the sole flue brick 102 of a recuperator or regenerator. A plurality of support bricks 104 rest on brick 102 for supporting a checkerwork of bricks. Bricks A1, A2, AX are shown with a portion of their bottom surfaces 12 resting on support bricks 104. Obviously, support bricks 104 could be positioned in other locations for supporting bricks A.

With reference to FIGS. 4, 5 and 7, it will be recognized that a plurality of the bricks of the present application are stacked and interlocked in a plurality of tiers to form a checkerwork. Each tier has the bricks arranged therein with their common walls extending substantially parallel to one another. In addition, the bricks in each tier have their common walls extending substantially perpendicular to the common walls of the bricks in adjacent tiers. Also, individual bricks in each tier are in engagement with and interlocked with at least two individual bricks in adjacent tiers.

It will be recognized that the brick of the present application can be manufactured in many different sizes. One typical example of a size will be given, and it will be understood that it is only an illustrative example and should not be taken in a limiting sense. Brick A may have a length between outer end surfaces 29, 39 of independent end walls 26, of about 14.125 inches. The width of Brick A between outer end surfaces 28, 38 and 38, 40 of transverse independent walls 25, 27 and 35, 37 is about 6.625 inches. The height of the brick between top and bottom walls 10, 12 is approximately five inches. The thickness of all the walls is approximately 1.750 inches. The distance between intersection centerlines 18, 20 is approximately 7.500 inches. The distance or length of each independent wall measured from an intersection centerline 18 or 20 to the outer end surface of each independent wall is about 3.313 inches. The independent transverse walls project outwardly from common wall 22 about 2.438 inches. Likewise, independent end walls 26, 36 project outwardly beyond the transverse independent walls approximately 2.438 inches. Notches 60–65 have a height and a width of about one inch. Projections 50, 52 project upwardly above top surface 10 about 0.375 inch. Each projection has a large diameter of about 1.933 inches and a small diameter of about 1.500 inches, with the side wall thereof sloping inwardly at an angle of about 30°. Each recess 54, 56 has a depth of about 0.531 inch. Each recess has a large diameter of about 2.238 inches and a small diameter of about 1.625 inches, with the side wall thereof sloping inwardly at an angle of about 30°.

Figure 8:
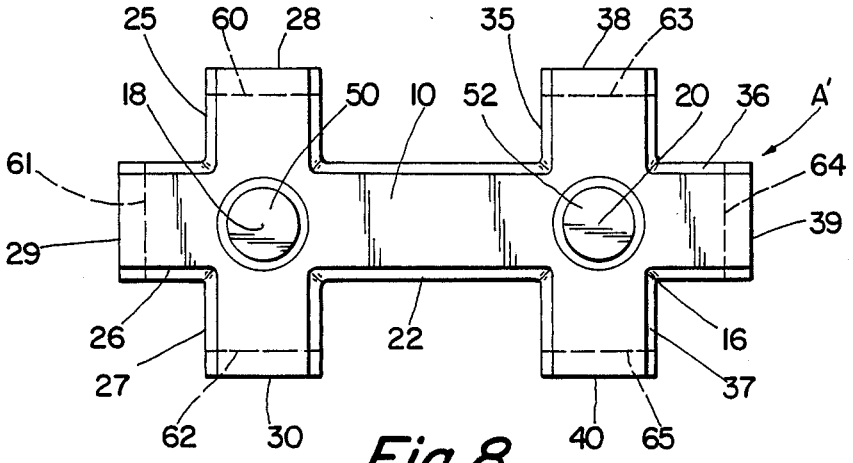
FIG. 8 is a top plan view of a modified form of checker brick.
Figure 9:
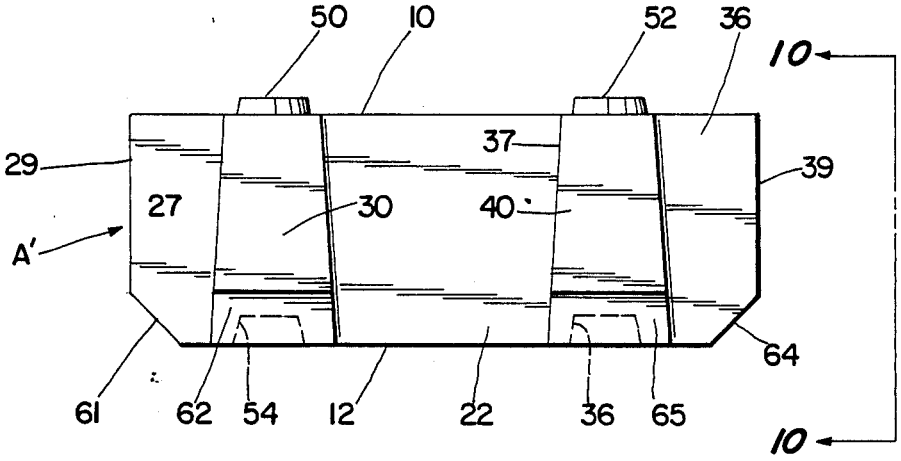
FIG. 9 is a side elevational view of the checker brick of FIG. 1.
Figure 10:
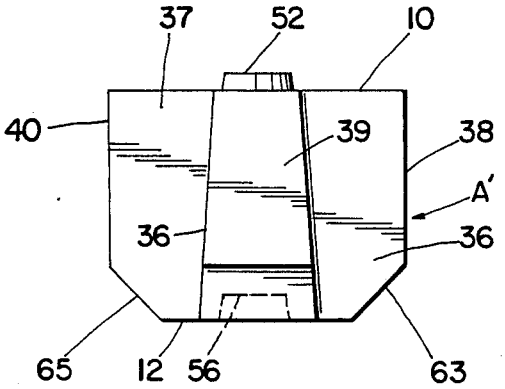
FIG. 10 is an end elevational view taken generally on line 10—10 of FIG. 9.

FIGS. 8–10 show brick A′ that differs from brick A of FIGS. 1–3 by having the opposite sides of the walls sloping outwardly or diverging from top surface 10 toward bottom surface 12. Thus, brick A′ has walls that are much wider at the bottom thereof than at the top thereof.

Figure 11:
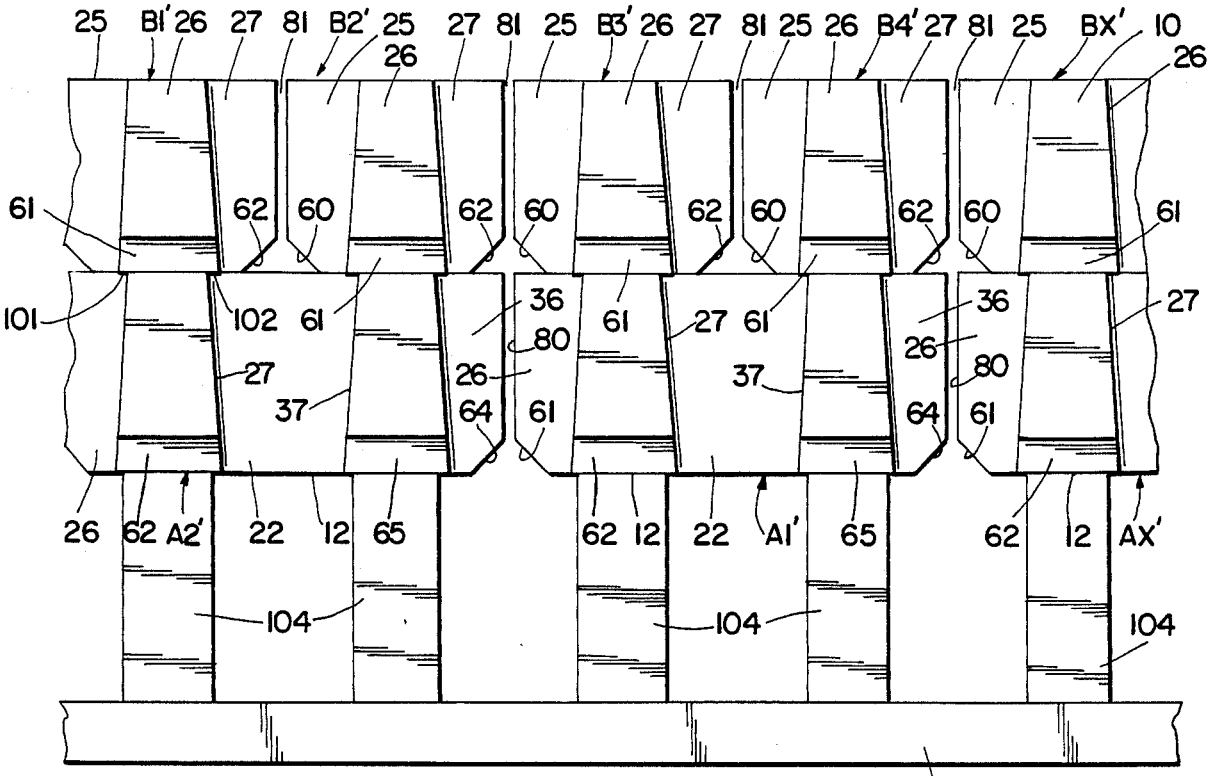
FIG. 11 is a view similar to FIG. 7 but showing the checker brick of FIGS. 8–10.

FIG. 11 shows a plurality of bricks of FIGS. 8–10 stacked on top of one another. Bricks B1′–BX′ of an upper tier are stacked on a lower tier of bricks A1′–AX′. Walls of the upper tier of bricks are aligned with walls of the lower tier of bricks. The wider bottoms of the walls on the upper tier of bricks project outwardly beyond the narrower tops of the walls on the lower tier of bricks to provide horizontal ledges 101, 102 that enhance turbulent flow as the gases pass through the flues.

Figure 12:
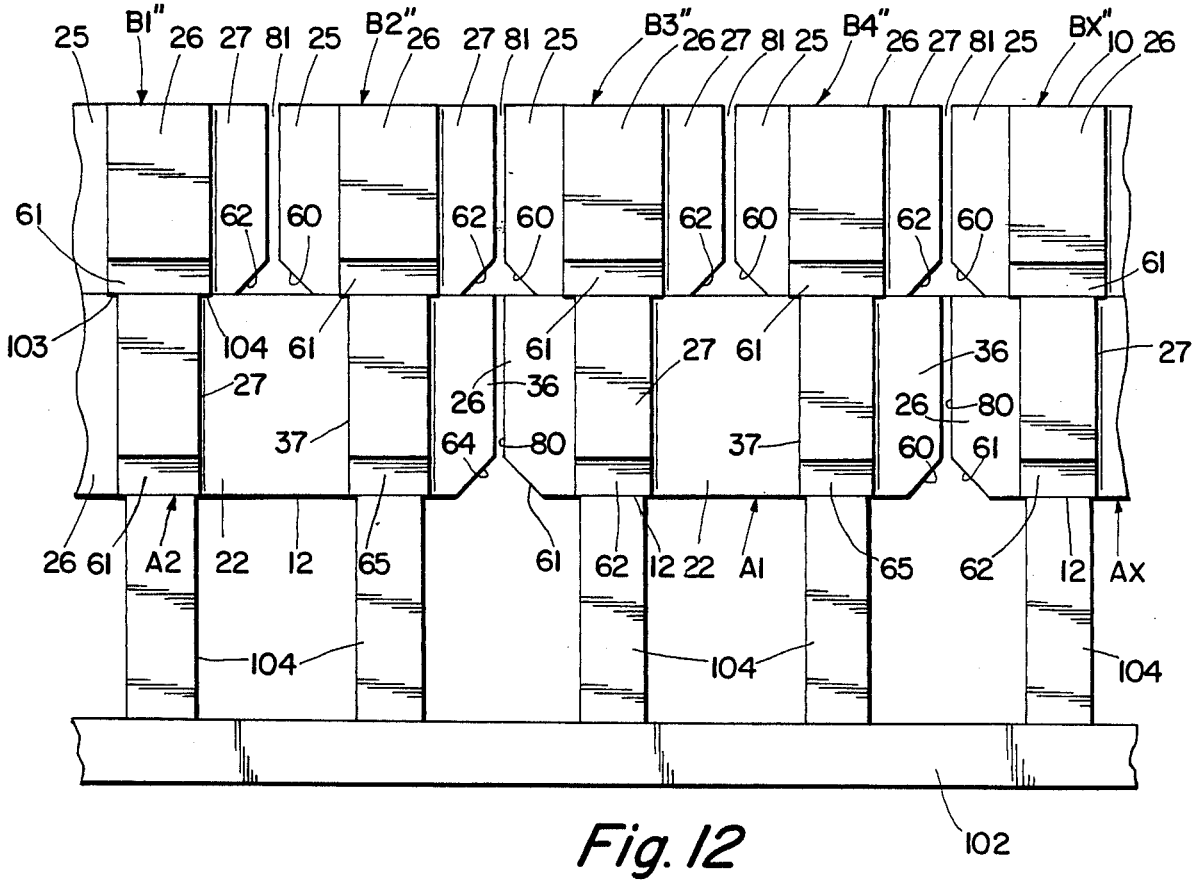
FIG. 12 is a view similar to FIGS. 7 and 11 showing bricks in adjacent tiers having different wall thicknesses.

FIG. 12 shows an arrangement wherein the lower tier of bricks A1–AX are the bricks of FIGS. 1–3. The upper tier of bricks B1″–BX″ are the same shape as the brick of FIGS. 1–3 but the walls thereof are thicker. Therefore, the bottoms of the walls on the upper tier of bricks project outwardly beyond the tops of the walls on the lower tier of bricks to provide horizontal ledges 103, 104 to enhance turbulent flow.

As best shown in FIG. 4, the preferred form of brick forms a checkerwork with substantially square flues. However, it will be recognized that certain of the improvements of the present application can be used with bricks dimensioned to provide rectangular flues that are not square. In such an arrangement, two different bricks can be used to form the checkerwork, with the walls of one brick having a length different from the walls of the other brick.

An advantageous feature of the brick of the present application is that the brick at the periphery of a checkerwork cooperates with the walls of the regenerator itself to form flues.

Another advantage of the brick of the present application is that a checkerwork can be torn down vertically to make hot repairs while minimizing removal of excess brick. Many prior art arrangements use a pyramid-like stacking arrangement that requires removal of a large number of adjacent bricks for making repairs. In the present application, the bricks are interlocked to provide stability and removing one vertical portion of a checkerwork will not cause adjacent portions to collapse. That is, the nature of the design is such that the stacked bricks do not spread out into a wider and wider base as one goes down through the stack. Instead, the bricks are stacked in vertical columns having substantially the same area throughout the vertical extent of the column.

There are several reasons why considerable slop is provided for in the interlocking projections and recesses. As the dye used to make the bricks wears, the projections become progressively larger and the recesses become progressively smaller. There is also a variation in the length of different bricks due to different shrinkage during firing. Bricks that are closer to the flame and heated to a higher temperature during firing will shrink more than other bricks. Also, the bricks expand in use but they do not always expand uniformly from a center point. Thus, the bricks may expand considerably more in one direction than another within the checkerwork.

Although the invention has been shown and described with reference to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A checker brick including walls intersecting at a plurality of spaced intersections having intersection centerlines, a common wall extending between each adjacent pair of said intersections, four walls (including said common walls) extending outwardly from each said intersection and being equidistantly-spaced therearound, said four walls at each intersection that are not common walls being independent walls, said brick having top and bottom surfaces, and each said intersection having a projection on one of said surfaces and a mating recess on the opposite one of said surfaces, whereby a plurality of bricks are stackable in interlocked relationship with said projections and recesses on adjacent bricks interdigitated.

2. The brick of claim 1 wherein said independent walls have outer end surfaces intersecting said top and bottom surfaces, and at least certain of said surfaces being cut-away adjacent at least one of said top and bottom surfaces to provide transverse gas flow passages in a checkerwork of stacked and interlocked bricks.

3. The brick of claim 2 wherein all of said end surfaces are cut-away adjacent said bottom surface.

4. The brick of claim 2 wherein said end surfaces are cut-away along substantially less than one-half their height.

5. The brick of claim 2 wherein said end surfaces are cut-away at angles of about 45°.

6. The brick of claim 1 wherein all of said independent walls having substantially the same length measured from an intersection centerline to the terminal end of the independent wall, each said common wall having a length measured between an adjacent pair of intersection centerlines that is not less than about two times the length of an independent wall.

7. The brick of claim 1 wherein said projections and recesses are generally frusto-conical shaped.

8. The brick of claim 1 wherein all of said walls have substantially the same thickness.

9. The brick of claim 1 wherein said independent walls include transverse walls extending substantially perpendicular to said common wall and projecting outwardly on opposite sides of said common wall, said independent walls further including and walls projecting outwardly substantially perpendicular to said transverse walls, said transverse walls projecting out from said common wall a predetermined distance that is between one and one-half times the thickness of said walls, and said end walls projecting out from said transverse walls the same predetermined distance as said transverse walls project out from said common wall.

10. The brick of claim 1 wherein said common wall has a length between adjacent intersection centerlines that is slightly greater than two times the distance from an intersection centerline to the terminal end of an independent wall.

11. The brick of claim 1 including a plurality of such bricks stacked and interlocked in a plurality of tiers to form a checkerwork, each tier having said bricks arranged therein with said common walls thereof extending substantially parallel to one another, each tier having the common walls of the bricks therein extending substantially perpendicular to the common walls of the bricks in adjacent tiers, and each individual brick in each tier being in engagement with and interlocked with at least two individual bricks in adjacent tiers.

12. The checkerwork of claim 11 wherein said independent walls include transverse walls extending substantially perpendicular to said common wall and end walls aligned with said common wall, each individual brick in each tier having said transverse walls thereof aligned with the common wall and end wall of bricks in adjacent tiers.

13. The checkerwork of claim 11 wherein said independent walls have outer end surfaces intersecting said top and bottom surfaces, and said end surfaces being cut-away adjacent at least one of said top and bottom surfaces to define transverse gas flow passages in the checkerwork.

14. The checkerwork of claim 11 wherein said independent walls have outer end surfaces intersecting said top and bottom surfaces, said bricks in each tier being arranged to provide transverse flow passages between facing ones of said end surfaces on adjacent bricks.

15. The checkerwork of claim 11 wherein each said brick common wall has a length between adjacent intersection centerlines that is greater than two times the length of an independent wall as measured from an intersection centerline to a terminal end of such independent wall, said independent walls having outer end surfaces, and said bricks being stacked with facing ones of said end surfaces on adjacent bricks spaced-apart from one another to provide transverse gas flow passages between adjacent vertical gas flow passages.

16. The checkerwork of claim 11 wherein at least certain tiers of bricks have wall bottoms that are wider than the wall tops on which they rest to provide downwardly facing horizontal ledges in the flues formed by the checkerwork to enhance turbulent flow and improve heat transfer.

17. The brick of claim 1 wherein said independent walls have outer end surfaces shaped to provide transverse gas flow passages between facing ones of said end surfaces on adjacent bricks arranged in a tier.

18. The brick of claim 1 wherein said walls are wider at said bottom surface than at said top surface.

19. The brick of claim 1 wherein said walls have sides that diverge in a direction from said top surface toward said bottom surface.

20. A checkerwork formed by a plurality of tiers of stacked and interlocked bricks, each brick having plural walls intersecting at a plurality of spaced intersections, each brick having opposite plane surfaces between which said walls are located, projections on one of said surfaces at said intersections and mating recesses on the other of said surfaces at said intersections, said bricks being stacked with all of the bricks in one tier having their projections and recesses interdigitated with recesses and projections on bricks in adjacent tiers, and each brick in each tier being in engagement with at least two bricks in adjacent tiers.

21. The checkerwork of claim 20 wherein said walls include independent walls having outer end surfaces, said bricks in each tier being positioned for providing transverse gas flow passages between adjacent facing end surfaces on adjacent bricks.

22. The checkerwork of claim 20 wherein said end surfaces are cut-away to provide said transverse gas flow passages.

23. The checkerwork of claim 20 wherein said walls include a common wall extending between adjacent intersections and a plurality of independent walls extending outwardly from each said intersection, said common wall and said independent walls at each said intersection being equidistantly-spaced around such intersection.

24. The checkerwork of claim 20 wherein at least certain tiers of bricks have wall bottoms that are wider than the wall tops on which they rest to provide downwardly facing horizontal ledges in the flues formed by the checkerwork to enhance turbulent flow and improve heat transfer.

25. The checkerwork of claim 20 wherein said walls have sides that diverge in a direction from said top surface toward said bottom surface.

* * * * *